US012715634B2

(12) United States Patent
Hébert et al.

(10) Patent No.: US 12,715,634 B2
(45) Date of Patent: Aug. 25, 2026

(54) TRAY FOR SYSTEM FOR AUTOMATIC FILLING OF MEDICATION BLISTER CARDS

(71) Applicant: Synergy Medical BRG Inc., Longueuil (CA)

(72) Inventors: Mathieu Hébert, Québec (CA); Abderrahmane Chalah, Québec (CA); Stéphane Banville, Montréal (CA)

(73) Assignee: SYNERGY MEDICAL BRG INC., Longueuil (CA)

( * ) Notice: Subject to any disclaimer, the term of this patent is extended or adjusted under 35 U.S.C. 154(b) by 130 days.

(21) Appl. No.: 18/323,247

(22) Filed: May 24, 2023

(65) Prior Publication Data

US 2023/0391482 A1 Dec. 7, 2023

Related U.S. Application Data

(60) Provisional application No. 63/348,321, filed on Jun. 2, 2022.

(51) Int. Cl.

| | |
|---|---|
| ***B65B 11/52*** | (2006.01) |
| ***B65B 5/06*** | (2006.01) |
| ***B65B 5/08*** | (2006.01) |
| ***B65B 5/10*** | (2006.01) |
| ***B65B 35/38*** | (2006.01) |
| ***B65B 39/00*** | (2006.01) |

(52) U.S. Cl.

CPC ..... *B65B 11/52* (2013.01); *B65B 5/068* (2013.01); *B65B 5/08* (2013.01); *B65B 5/103* (2013.01); *B65B 35/38* (2013.01); *B65B 39/007* (2013.01)

(58) Field of Classification Search

CPC ..... B65B 5/068; B65B 5/08; B65B 5/103; B65B 5/105; B65B 11/52; B65B 35/38; B65B 39/007; B65B 67/02; B65B 9/045; B65B 35/06

USPC ..... 53/246, 247, 559

See application file for complete search history.

(56) References Cited

U.S. PATENT DOCUMENTS 3,135,225 A * 6/1964 Winkler et al. ..... A23G 3/203 221/13

3,545,164 A * 12/1970 Middleton ..... B65B 5/103 53/247

(Continued)

FOREIGN PATENT DOCUMENTS

WO 2018157231 A1 9/2018

OTHER PUBLICATIONS

"International Search Report and Written Opinion corresponding to International Application No. PCT/CA2023/050715 mailed Sep. 1, 2023".

(Continued)

*Primary Examiner* — Anna K Kinsaul

(74) *Attorney, Agent, or Firm* — Myers Bigel, P.A.

(57) ABSTRACT

A tray for facilitating the dispensing of pharmaceuticals includes: a generally planar main panel; and a plurality of receiving apertures arranged in a grid of rows and columns. A side wall lines each of the receiving apertures. The side wall comprises a receiving segment and a capture segment, the capture segment opposed to the receiving segment, wherein the receiving segment is positioned directly beneath the receiving aperture and defines a receiving angle relative to the main panel, the receiving angle being between about 30 and 70 degrees.

18 Claims, 7 Drawing Sheets

(56) References Cited

U.S. PATENT DOCUMENTS

| | | | | |
|---|---|---|---|---|
| 3,775,941 | A * | 12/1973 | Bross | B65B 5/103 221/296 |
| 4,627,225 | A * | 12/1986 | Faller et al. | B65B 5/103 141/93 |
| 8,230,662 | B2 | 7/2012 | Boutin | |
| 8,584,434 | B2 * | 11/2013 | Kodama et al. | B65B 5/103 53/235 |
| 9,770,390 | B2 | 9/2017 | Aggarwal et al. | |
| 10,926,901 | B2 * | 2/2021 | Kim | B65B 35/44 |
| 2006/0076077 | A1 * | 4/2006 | Kaplan et al. | B65B 5/103 141/144 |
| 2008/0223001 | A1 * | 9/2008 | Monti | B65B 5/105 53/246 |
| 2013/0042574 | A1 * | 2/2013 | Knoth | B65B 5/103 53/246 |
| 2023/0141858 | A1 * | 5/2023 | Arsenault et al. | B65B 5/103 206/538 |

OTHER PUBLICATIONS

International Preliminary Report on Patentability corresponding to PCT/CA2023/050715; issued Nov. 7, 2024 (7 pages).

* cited by examiner

| TEST NO. | TEST DESCRIPTION | PILL TYPE | Z OFFSET | H OFFSET | REBOUND (A) | REBOUND (B) | REBOUND (C) | NO. OF CARDS | NO. OF DEPOSITS | (A) REBOUNDS (%) | (A)+(B) TOTAL REBOUNDS (%) |
|---|---|---|---|---|---|---|---|---|---|---|---|
| 1 | CONTROL (NO TRAY) | 1 | 0 | 0 | 4 | 5 | 20 | 6 | 186 | 2.15% | 4.84% |
| 2 | CONTROL TRAY 100 | 1 | 0 | 0 | 4 | 10 | 11 | 4 | 124 | 3.23% | 11.29% |
| 3 | TRAY 200, .1875″ Z | 1 | 0.1875 | 0 | 1 | 1 | 12 | 4 | 124 | 0.81% | 1.62% |
| 4 | TRAY 200, .375″ Z | 1 | 0.375 | 0 | 4 | 0 | 17 | 4 | 124 | 3.23% | 3.23% |
| 5 | TRAY 200, .25″ Z | 1 | 0.25 | 0 | 0 | 0 | 3 | 4 | 124 | 0% | 0% |
| 6 | TRAY 200, .25″ Z, + 0.25″ H | 1 | 0.25 | 0.25 | 0 | 0 | 3 | 4 | 124 | 0% | 0% |
| 7 | CONTROL TRAY 100 | 2 | 0 | 0 | 1 | 1 | 0 | 6 | 186 | 0.54% | 1.08% |
| 8 | TRAY 200, .25″ Z | 2 | 0.25 | 0 | 0 | 1 | 1 | 4 | 124 | 0% | 0.81% |
| 9 | TRAY 200, .25″ Z, + 0.25″ H | 2 | 0.25 | 0.25 | 0 | 1 | 4 | 5 | 155 | 0% | 0% |
| 10 | TRAY 200, .25″ Z, + 0.25″ H | 3 | 0.25 | 0.25 | 1 | 0 | 0 | 4 | 124 | 0.81% | 0.81% |

FIG. 9

TRAY FOR SYSTEM FOR AUTOMATIC FILLING OF MEDICATION BLISTER CARDS

RELATED APPLICATION

The present application claims priority from and the benefit of U.S. Provisional Patent Application No. 63/348,321, filed Jun. 2, 2022, the disclosure of which is hereby incorporated herein by reference in full.

FIELD OF THE INVENTION

The present invention is directed to the distribution of pills. More specifically, the present disclosure is concerned with a system for automatic filling of medication organizers.

BACKGROUND OF THE INVENTION

Doses of medication over prescribed periods vary as a function of the type of medication and the condition of the patient. Patients are often required to take a plurality of doses over different periods of a day, and this often leads to confusion. It may be difficult for a patient to respect the prescription details (e.g., intake time, quantity) when the doses and the types of medication are numerous.

One well known method used by pharmacists to overcome this problem is to provide the patient with a dose pack having an array of receptacles, with each receptacle corresponding to a particular time of a day at which medication is to be taken. Such packs typically contain four receptacles per day for seven days, and these receptacles are in the form of sealed cups filled with appropriate medication by pharmacists as a function of the prescription, as determined by physicians' prescription. Some types of these dose packs are known as "blister packs" or "blister cards," which typically include a plurality of wells or pockets arranged in a grid of rows and columns; for many blister cards, a row of wells may represent the medications taken at different times on a particular day, with each row representing a different day. Exemplary blister cards may have seven rows, such that the card represents a week's worth of medications for the patient. Alternative arrangements include 4×8 and 5×7 cards. Another alternative is a 28 or 31 day card, wherein a set of three or four such cards may represent a month's worth of medications, with each card providing medications for a particular time of day (e.g., one "breakfast" card, one "lunch" card, etc.). Also, some blister cards may be oriented 90 degrees from this arrangement, such that the columns represent different days.

The process of preparing these dose packs by hand can be labor-intensive, in that each receptacle must be filled individually. Therefore, although the dose pack facilitates the intake of medication by patients, a substantial amount of time is required to fill these packs by pharmacists.

As a result, automated systems for filling dose packs have been developed. For example, U.S. Pat. No. 8,230,662 B2 to Boutin (the disclosure of which is hereby incorporated herein by reference in full) describes a system for filling medication dose packs with oral-solid medication items. The system (sold under the name SynMed™ XF by Synergie Medicale, Quebec, Canada) comprises storage tray drawers, each of which has multiple storage trays or canisters. Each storage tray stores a specific type of oral solid medication item. The storage tray drawers are displaceable to a drawn position to expose the storage trays thereof. A table supports dosepacks having a plurality of receptacles arranged in rows, with each receptacle associated with an intake time and date of a patient prescription file. A dispensing mechanism, provided with an output arm is displaceable along the axes X, Y and Z in order to transport medication items from the medication storage trays to the dose packs. The dispensing mechanism includes individual pipettes that, via suction, lift individual pills from storage canisters and deposit them into dose packs residing on the table. Another variation of the system is shown in U.S. Patent Publication No. 2020/0016039 to Boutin, the disclosure of which is also incorporated by reference herein in full, a version of which is sold under the name SynMed™ Ultra.

U.S. Provisional Patent Application Nos. 63/226,383 and 63/282,780 discuss trays that are employed with dose packs such as blister cards to receive manually-loaded pills (and in some instances may indicate, via LEDS or the like, whether a pill has been properly deposited). The trays overlie blister cards and have holes that mimic the arrangement of the wells of the blister card. The blister cards are filled through the holes in the trays, then are transported to a second location, where they can be sealed and further processed.

One potential issue with the system discussed in U.S. Pat. No. 8,230,662, supra, and other automated blister card systems (and even some manual filling systems) is a tendency for pills deposited by the pipettes to "bounce" or "rebound" from the wells of the blister cards after being dropped by the pipettes. Clearly, if a pill rebounds from, and therefore does not remain within, the correct well, this error must be addressed (typically manually) after the card is filled. For some combinations of blister cards and pills, as many as 60 or 70 percent of blister cards filled by the system require manual correction, which clearly negatively impacts the productivity of the system. As such, it may be desirable to provide a system that can reduce, if not eliminate entirely, rebounding pills.

SUMMARY OF THE INVENTION

As a first aspect, embodiments of the invention are directed to a tray for facilitating the dispensing of pharmaceuticals. The tray comprises: a generally planar main panel; and a plurality of receiving apertures arranged in a grid of rows and columns. A side wall lines each of the receiving apertures. The side wall comprises a receiving segment and a capture segment, the capture segment opposed to the receiving segment, wherein the receiving segment is positioned directly beneath the receiving aperture and defines a receiving angle relative to the main panel, the receiving angle being between about 30 and 70 degrees.

As a second aspect, embodiments of the invention are directed to a pharmaceutical package filling machine comprising: a plurality of containers, each containing pharmaceutical tablets; a support surface configured to support a blister card; a dispensing tool configured to convey tablets from a container to a blister card supported by the support surface; and a tray configured to overlie the blister card supported by the support surface. The tray comprises: a generally planar main panel that overlies the blister card; and a plurality of receiving apertures arranged in a grid of rows and columns corresponding to wells in the blister card. A side wall lines each of the receiving apertures. The side wall comprises a receiving segment and a capture segment, the capture segment opposed to the receiving segment, wherein the receiving segment is positioned directly beneath the receiving aperture and defines a receiving angle relative to the main panel, the receiving angle being between about 30 and 70 degrees.

As a third aspect, embodiments of the invention are directed to a tray for facilitating the dispensing of pharmaceuticals comprising: a generally planar main panel; and a plurality of receiving apertures arranged in a grid of rows and columns. A side wall lines each of the receiving apertures. The side wall comprises a receiving segment and a capture segment, the capture segment opposed to the receiving segment, wherein the receiving segment is positioned directly beneath the receiving aperture and defines a receiving angle relative to the main panel, the receiving angle being between about 40 and 50 degrees, and wherein the capture segment is below but not directly beneath the receiving aperture and defines a capture angle relative to the main panel, the capture angle being between about 95 and 120 degrees.

BRIEF DESCRIPTION OF THE FIGURES

FIG. 9 is a chart displaying experimental results of testing on trays as shown in FIG. 5 and FIGS. 6-8.

DETAILED DESCRIPTION OF THE INVENTION

Figure 1:
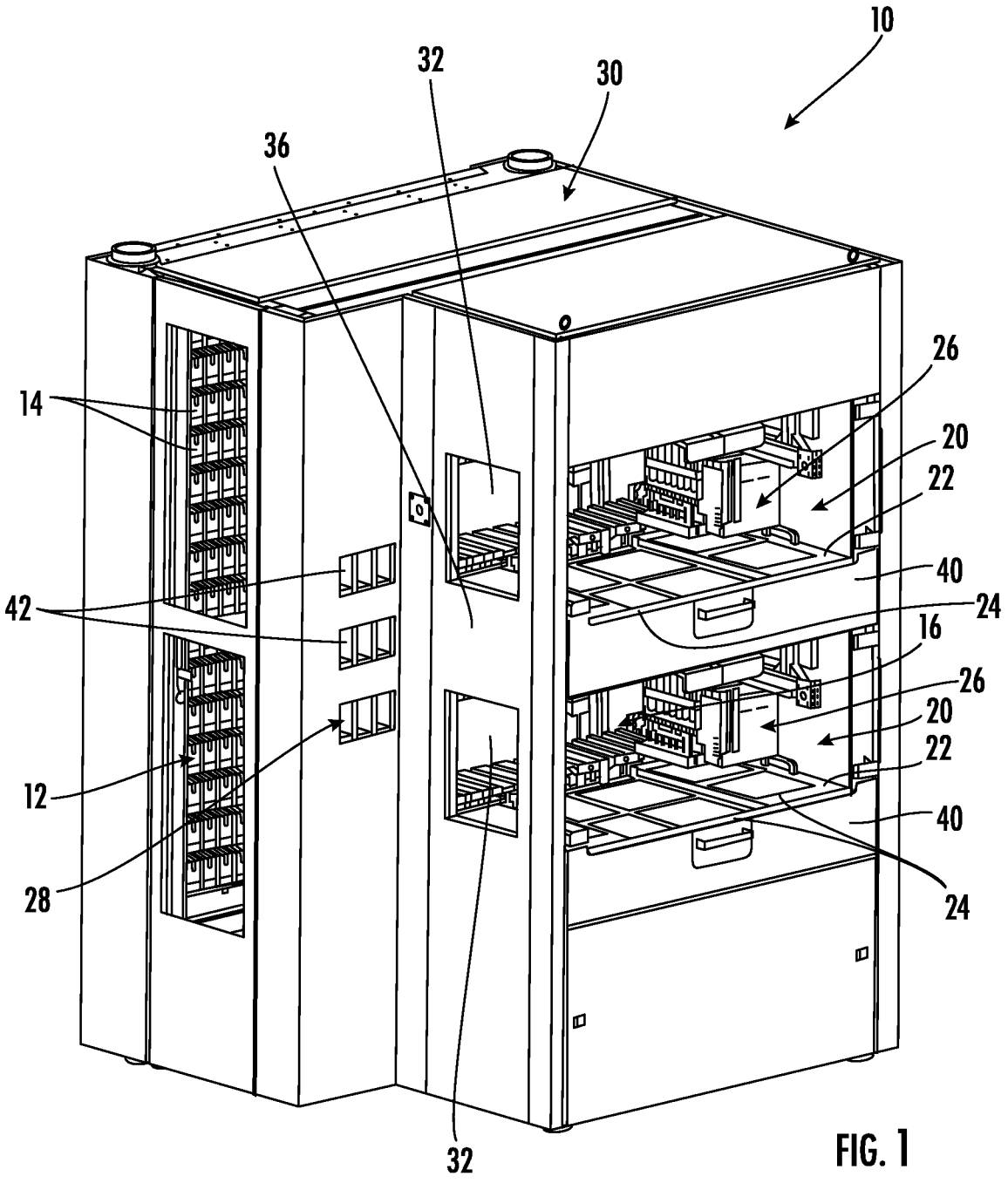
FIG. 1 is a front perspective view of a system for filling pharmaceutical blister cards.

The present invention will now be described more fully hereinafter, in which preferred embodiments of the invention are shown. This invention may, however, be embodied in different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout. Thicknesses and dimensions of some components may be exaggerated for clarity.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein the expression "and/or" includes any and all combinations of one or more of the associated listed items.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

As used herein, the term "forward" and derivatives thereof refer to the general direction vial carriers and vials travel as they move from station to station; this term is intended to be synonymous with the term "downstream", which is often used in manufacturing environments to indicate that certain material being acted upon is farther along in the manufacturing process than other material. Conversely, the terms "rearward" and "upstream" and derivatives thereof refer to the directions opposite, respectively, the forward and downstream directions.

Well-known functions or constructions may not be described in detail for brevity and/or clarity.

Referring now to the drawings, a system for filling pharmaceutical blister cards is shown in FIG. 1 and designated broadly at 10. The system 10 comprises: a container storage unit 12 for receiving a plurality of medication containers 14; two medication organizer filling units 20, each including i) a temporary storage rack 16, ii) a support table 22 for receiving and indexing a plurality of medication organizers 24 (also referred to herein as "dose packs" or "blister cards"); and iii) a medication dispensing tool 26 for picking medications (not shown) from one of the medication containers 14 on the temporary storage rack 16 and for moving the medications into the blister cards 24 on the support table 22; a container handling system (not shown explicitly herein) for moving selected medication containers 14 between the container storage unit 12 and the medication organizer filling units 20; and a container replenishing rack (also not shown explicitly herein).

In summary, containers 14, including different solid oral medications, are stored in the container storage unit 12 and a plurality of empty blister cards 24 are arranged in predetermined positions on the support tables 22 of the filling units 20. The container handling system retrieves one by one in the storage unit 12 the containers 14 corresponding to medications that need to be filled in the blister cards 24 according to patient prescription profiles inputted in the system 10. The container handling system moves each container 14 to a selected one of the two medication organizer filling units 20, which fills the blister cards 24 according to the patient prescription profile.

The above-listed components are contained in an enclosure 30 that includes windows 32, doors 36, drawers 40 and openings 42 that allows visualizing the operation of the system 10 and accessing some of the components of the system 10 for maintenance or replenishing thereof as will be described hereinbelow in more detail.

Figure 2:
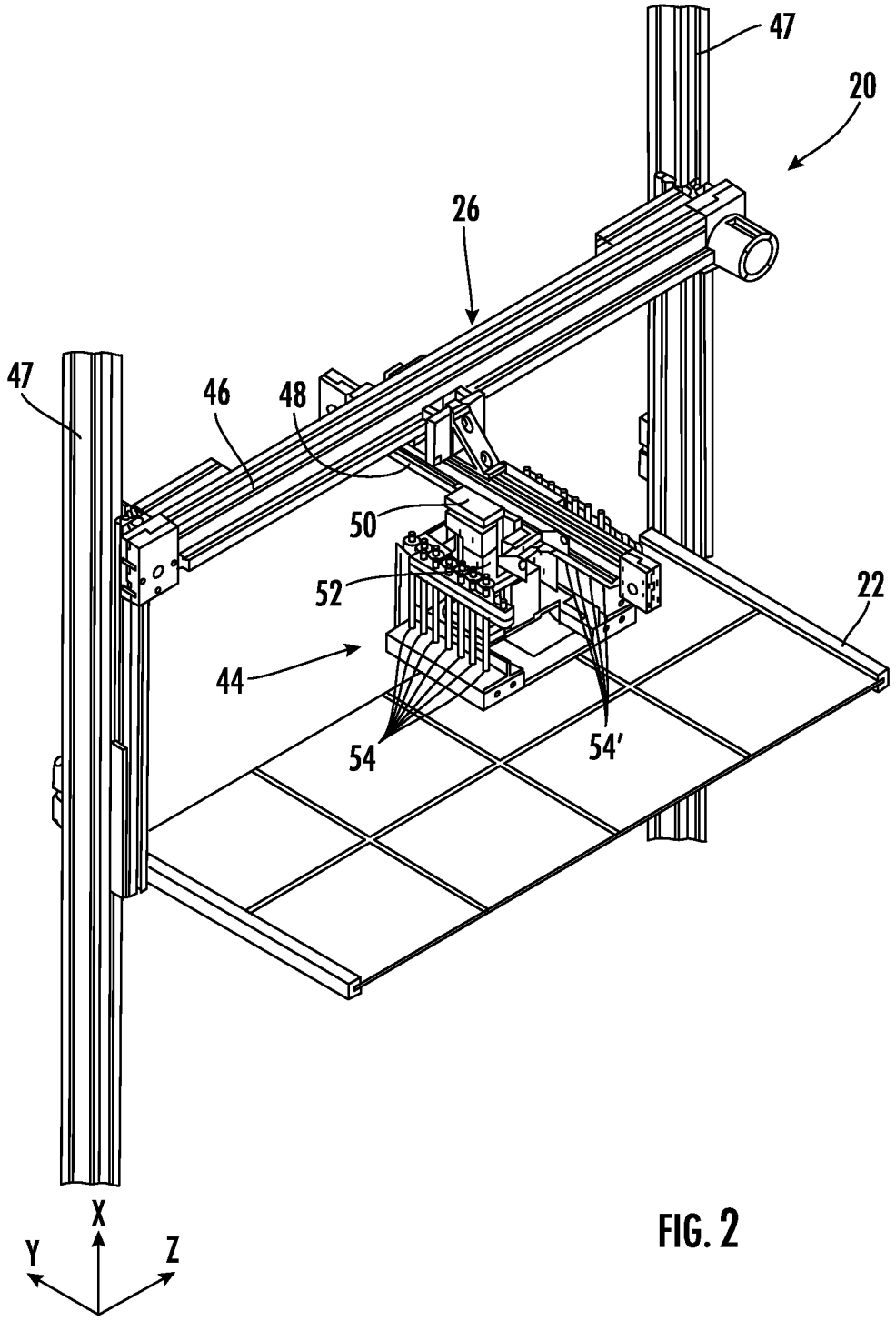
FIG. 2 is a perspective view of the positioning rails and carriage of the system of FIG. 1.
Figure 3:
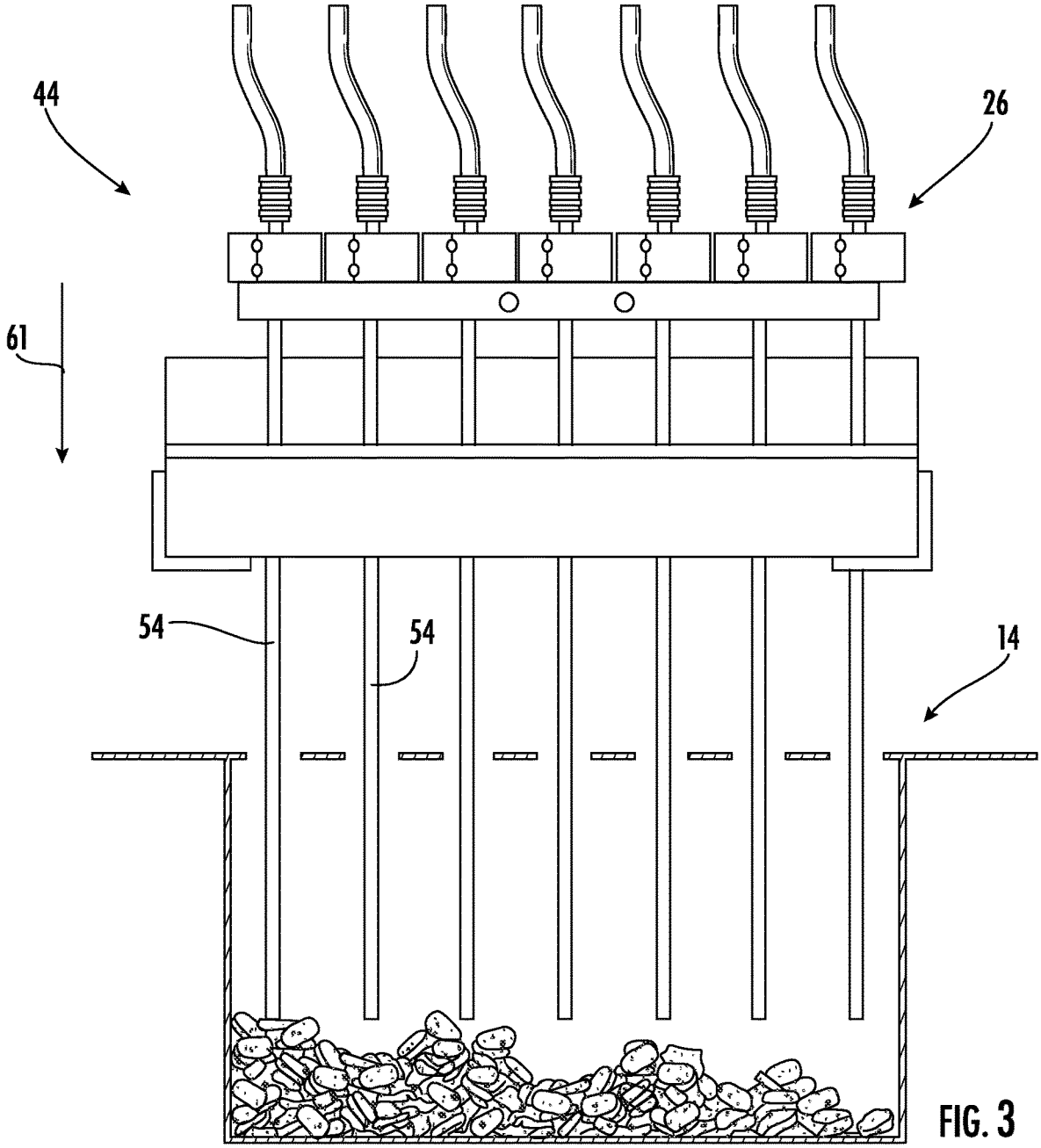
FIG. 3 is a side view of the fingers of the dispensing tool of FIG. 2 shown inserted into a container with pills therein.

With reference to FIGS. 2 and 3, one of the organizer filling units 20 will be described. The dispensing tool 26 of the filling units 20 includes a tool head 44 that is displaceable along three translational degrees-of-freedom (hereinafter DOF), as illustrated by directions X, Y and Z in FIG. 2 ("X" being the vertical direction). Moreover, it is contemplated to provide a translational or rotational DOF to the tool head 44. The filling unit 20 has a first support beam 46 slidably mounted on a pair of vertical posts 47. The vertical posts 47 are typically a pair of linear actuators, with the moving portion of the linear actuators connected to opposed ends of the first support beam 46 such that the first support beam 46 is displaceable along the Z direction. A second support beam 48 is operatively connected to the first support beam 46, such that the second support beam 48 is displaceable along direction X with respect to the first support beam 46. For instance, the first support beam 46 is a linear actuator, with a moving portion of the linear actuator connected to the second support beam 48.

A carriage 50 is mounted to the second support beam 48, and is displaceable along direction Y with respect to the second support beam 48. The tool head 44 is fixedly mounted to the carriage 50 so as to be supported therefrom. An actuator 52 is provided for the independent actuation of the tool head 44 with respect to a remainder of the filling unit 20. Accordingly, there are two degrees of actuation for the tool 26 in the vertical direction. According to the illustrated embodiment, the actuator 52 is a linear actuator providing an additional translational degree of actuation along the Z axis. This linear actuator is preferably used for the capsule-grasping movements of the tool head 44. In such a case, the actuator 52 is advantageously smaller and more power-efficient than the linear actuators of the vertical posts 47, considering the numerous displacements to be performed by the tool head 44.

Figure 4:
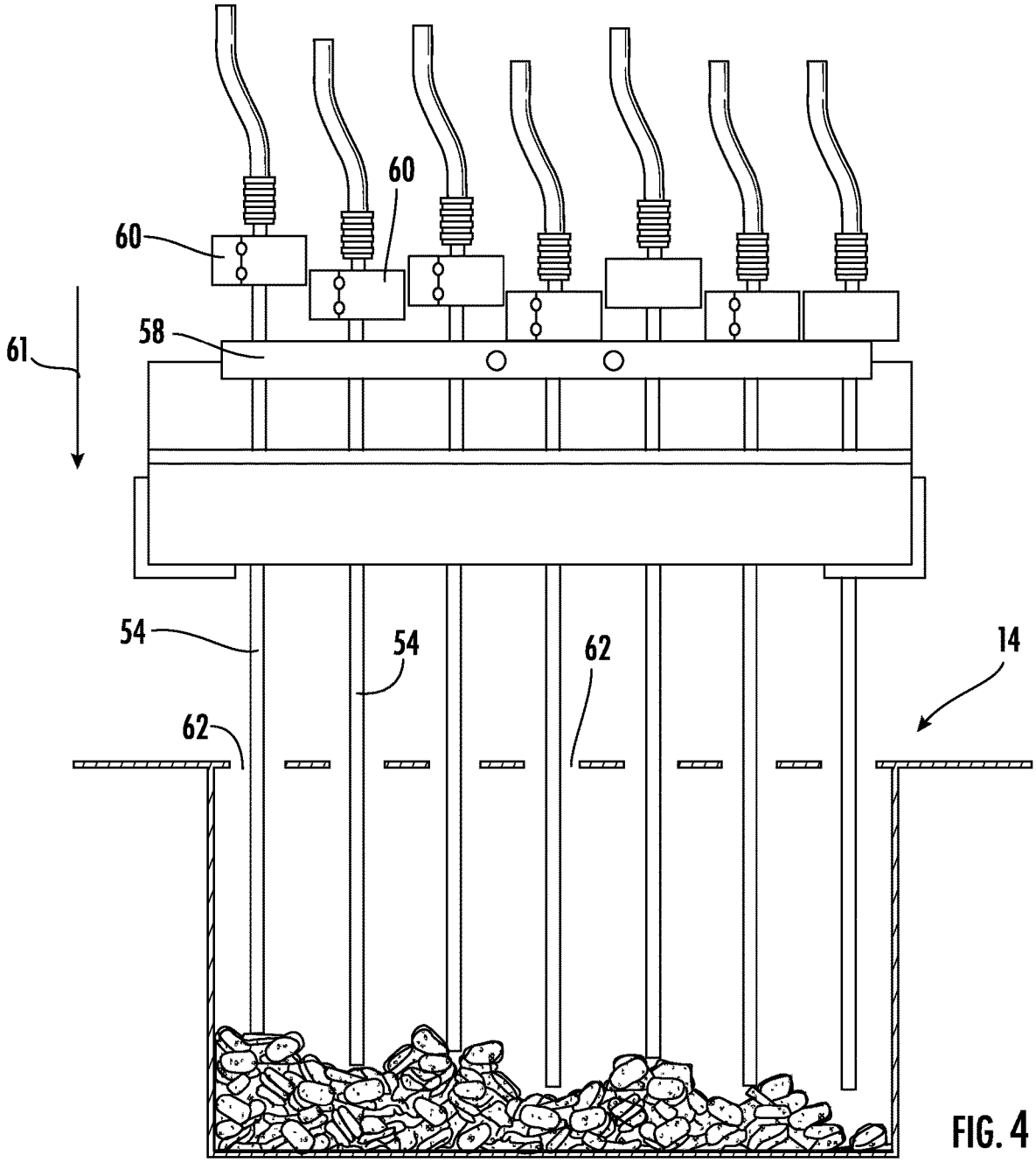
FIG. 4 is a side view of the fingers of the dispensing tool of FIG. 2 shown with some of the fingers lowered to pick up pills from a container.

The tool head 44 has two rows of seven fingers 54, 54' (see FIGS. 3 and 4). Each of the fingers 54 is provided to carry an oral-solid medication item or tablet, pill, capsule, gel-cap or the like (hereinafter "medication item" for simplicity purposes) from containers 14 to blister cards 24, as will be described hereinafter. According to the illustrated embodiment, each of the fingers 54 has a suction tip by which medication items are releasably connected to the fingers 54. One of the two series of seven fingers 54, 54' may be of different sizes (e.g., smaller) to be capable of grasping smaller medication items. A trap (not visible) is actuated to determine which set of the fingers 54 or 54' is moved downwardly to grasp medication items.

Referring still to FIGS. 3 and 4, the fingers 54 are slidably mounted to a support rack 58 so as to be displaceable in translation along the Z axis. A ring 60 is provided at the proximate end of each finger 54 to bias the fingers 54 downwardly under the force of gravity. In operation, the support rack 58 is moved downwardly (see arrow 61) while the fingers 54 are being inserted within the container 14 through holes 62 in the container's cover 56.

The fingers 54 are freely mounted onto the support rack 58 so as to be displaceable vertically, while being pulled downwardly by the effect of gravity. With reference to FIG. 4 this allows fingers 54 that have reached the level of content to slide upwardly relative to the support rack 58 while the tips of other fingers 54 continue to move towards the bottom until they reach the level of content therein. Accordingly, the risk of having a medication item dislodged from one of the fingers 54 is reduced by this suspension mechanism. The fingers 54 are each connected to a vacuum system (not shown), such that a tip of each of the fingers 54 is subjected to a pressure differential from ambient pressure, that will be of sufficient magnitude to grasp a medication item. The suction at the tip of each of the fingers 54 is controlled individually, such that any combination of the fingers 54 can be actuated over the seven-day period represented by a row of the dose packs 24. This is typically performed by on/off valves between the vacuum source and the tips of the fingers 54.

Figure 5:
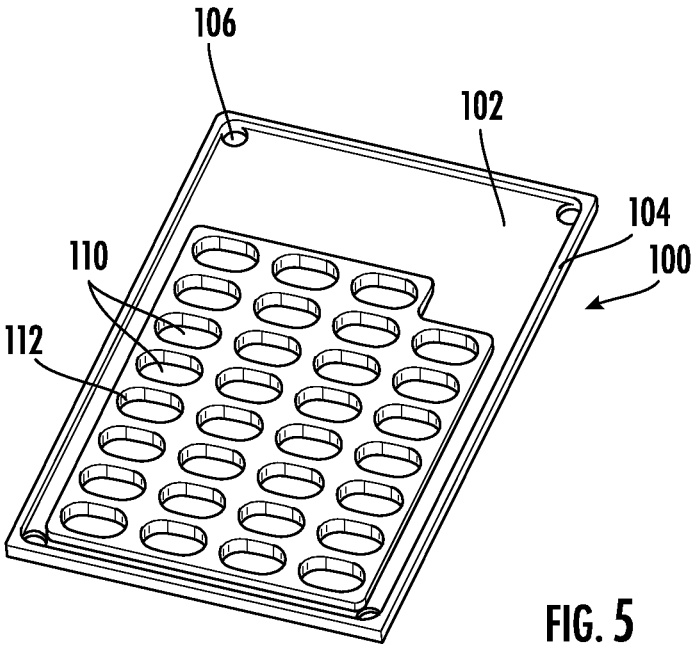
FIG. 5 is a perspective view of a tray that can be used to facilitate filling of blister cards with the system of FIG. 1.

Referring now to FIG. 5, a tray 100 that might be used with the system 10 is shown therein. As shown in FIG. 5, the tray 100 has a generally rectangular main body 102 with an outer rim 104. Mounting holes 106 are present in each corner. In use, the tray 100 overlies a blister card 24 and can facilitate loading of the blister card 24 with medications.

A grid of receiving apertures 110 is present on the main body 102. The receiving apertures 110 are generally oblong or oval in shape and are arranged to match the grid pattern of a blister card 24 that underlies the tray 100 in use. In this embodiment of the tray, each of the receiving apertures 110 is lined about its perimeter with side walls 112 that extend downwardly from the main body 102 at an angle that is substantially normal to the main body 102. The side walls 112 help to guide a pill dispensed by the system 10 into a well of a blister card 24 that underlies the tray 100 and to prevent pills from slipping out between the main body 102 and the upper edges of the well and/or rebounding from the well. The receiving apertures 110 may be of any configuration that substantially matches the shape of the wells of the underlying blister card 24. As one example, a receiving aperture 110 may be 0.725 inches in width, 1.208 inches in length, and have generally semicircular ends.

In some embodiments, the tray 100 may have indicators (e.g., LEDs or the like) mounted on the main panel adjacent the receiving apertures 110 to indicate the status of the corresponding well of the blister card 24 underlying the tray 100. For example, the indicator may illuminate when a well is to be filled, display a second, different color when the well is filled, blink if dispensing is unsuccessful, etc. The tray 100 may, in some instances, be used for manual loading of a blister card, or may be used for partial manual loading that precedes automated loading. As an example of the latter, a less frequently dispensed drug (i.e., one that is not frequently dispensed enough to be used in the system 10) may be hand loaded into a blister card (aided by the tray 100), then placed in the system for automated loading as described below.

As described above, when the tray 100 is used in conjunction with the system 10, in some instances pills dropped from a finger 54 through a receiving aperture 110 will strike the floor of the well of the blister card 24 and rebound out of the well and the receiving aperture 110. This can occur with sufficient frequency as to negatively impact productivity, because each rebounding pill must be replaced manually after filling of the rest of the blister card 24 is complete, and because the frequency of rebounds, manual checking and some re-loading of the blister card may be required after initial loading.

Figure 6:
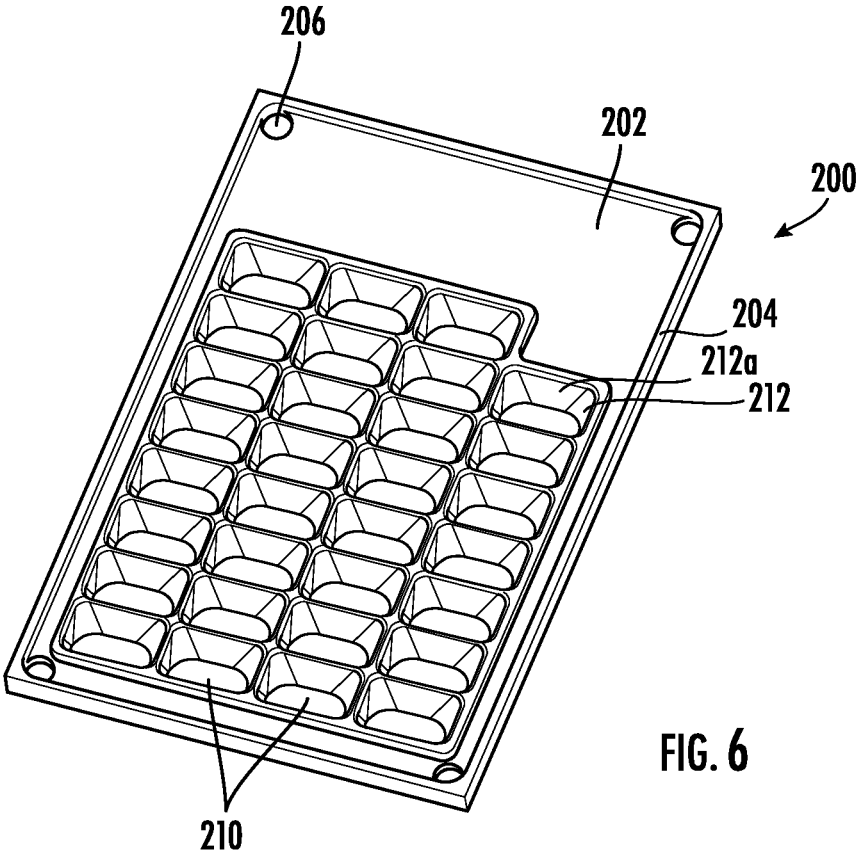
FIG. 6 is a perspective view of a tray according to embodiments of the invention that can be used to facilitate filling of blister cards with the system of FIG. 1.
Figure 7:
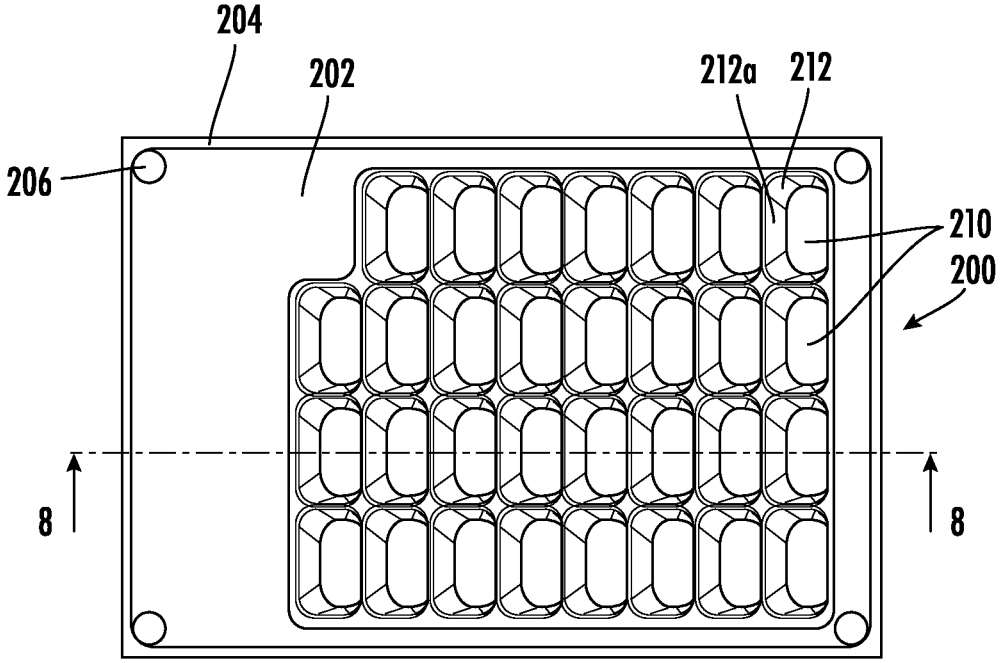
FIG. 7 is a top view of the tray of FIG. 6.
Figure 8:
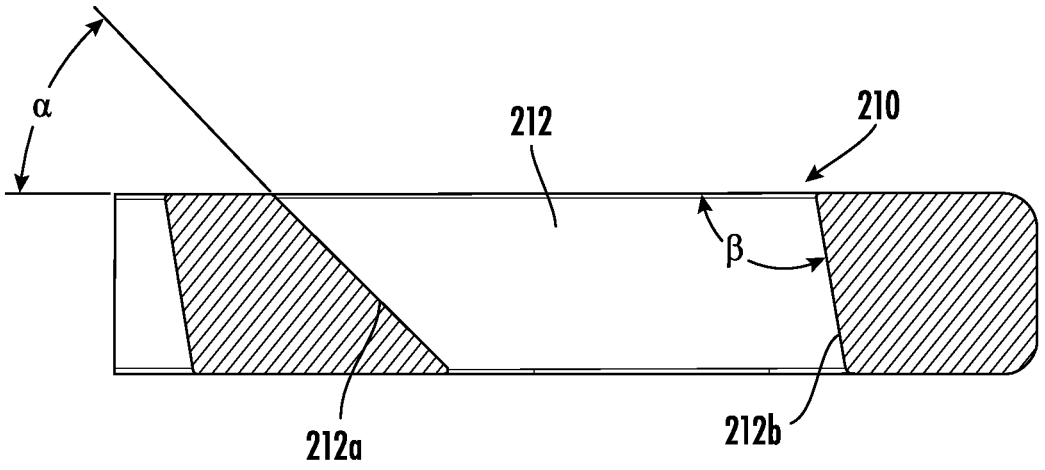
FIG. 8 is an enlarged section view taken along lines 8-8 of FIG. 7 showing the profile of one of the receiving apertures.

A tray that can address this issue is shown in FIGS. 6-8 and is designated broadly at 200. The tray 200 is similar to the tray 100 in that it has a main body 202, a rim 204, and mounting holes 206. Receiving apertures 210 are arranged in a grid similarly to the receiving apertures 110. However, the side walls 212 that line the receiving apertures 210 are configured and disposed to prevent rebounding of pills when they are deposited into the wells of underlying blister cards.

As shown in FIG. 8, the side wall 212 can be divided into a receiving segment 212*a* and a capture segment 212*b*. The receiving segment 212*a* is disposed at an acute receiving angle α relative to the plane defined by the main body 202 and extends directly beneath the corresponding receiving aperture 210. As a result, when a pill is dropped onto the upper surface of the receiving segment 212*a*, rather than the pill rebounding straight upwardly from the floor of the blister card well, as may be the case with the tray 100, the pill tends to rebound horizontally (i.e., to the right in FIG. 8) and therefore remain within the well. In some embodiments, the receiving angle α is between about 30 and 70 degrees; in certain embodiments, the receiving angle α is between about 40 and 50 degrees, with an angle α of 45 degrees for particular embodiments.

FIG. 8 also shows that the capture segment 212*b* of the side wall 212 is not disposed substantially normal to the main body 202 (as is the case with the side wall 112 of the tray 100), but instead is disposed at an obtuse capture angle β relative to the plane defined by the main body 202 and is not directly beneath the corresponding receiving aperture 210. After the pill rebounds generally horizontally from the receiving segment 212*a*, the pill may have sufficient energy to travel across the receiving aperture 210 to contact the capture segment 212*b*. In such an instance, the downward-facing capture angle β of the capture segment 212*b* can force the pill downwardly onto the floor of the well of the blister card, thereby retaining the pill within the well. In some embodiments, the capture angle β may be between about 95 and 160 degrees; in particular embodiments the capture angle β may be between about 95 and 120 degrees, with a capture angle β of 100 degrees being employed in certain embodiments.

It should be noted that the overall visible "footprint" of each of the receiving apertures 210 is the same as that of the receiving apertures 110 of the tray 100. This provides a similar sized and shaped opening for the pills as the fingers 54 drop the pills into the wells of the blister card. An exemplary width for the receiving apertures is between about 0.6 and 0.8 inch, an exemplary length is between about 0.8 and 1 inch, and an exemplary depth is between about 0.25 and 0.5 inch. It may be beneficial in some embodiments for the finger to target the receiving segment 212*a* of a receiving aperture 210 as the pill is being dropped (i.e., the drop target is offset from the center of the receiving aperture 210 toward the receiving segment 212*a*); this may be in contrast to the use of a conventional tray 100 as described above, as typically the center of the receiving aperture 110 is targeted by a finger 54 dropping a pill.

Those of skill in this art will appreciate that, although the side wall 212 is shown as being continuous, in some embodiments the side wall may be discontinuous, or may have slots or recesses in certain areas (e.g., at the rounded ends).

Experimentation has shown that use of a tray 200 can significantly reduce, or even eliminate entirely, pills rebounding from blister cards. Results from such experimentation are discussed below in the non-limiting examples.

Example 1

Experimental Set-Up

Experiments on pill rebound were conducted. A pill dispensing system, available from Syngerie Medicale (Quebec, Canada), sold under the trade name SYNMED™ XF and operating in a manner similar to that shown at 10 herein, was used to dispense pills into blister cards via an overlying tray. As a control, either no tray or a tray such as that identified above at 100 was employed. Experimental trays were employed that included receiving apertures with an angled receiving segment and an angled capture segment as described above at 200. The cross-section of receiving aperture 212 is shown in FIG. 8, such that a receiving angle of 45 degrees and a capture angle of 117 degrees were employed. The "footprint" of the receiving apertures 110, 210 was maintained for both control and experimental groups.

A Unidose blister card (available from Jones Healthcare) was employed during the experiments, as this card variety had proven in the past to be particularly susceptible to rebounding pills. Also, initially an aspirin pill was dispensed during the experiments; the pill is a round disk of 8.5 mm diameter, and had proven in the past to be particularly susceptible to rebounding.

During the experiments, any tray employed (either the control tray or an experimental tray) was overlaid on a blister card, the card and tray were positioned in the normal operational position within the system, and the pills were dispensed by the system in the typical manner. Each tray included 31 receiving apertures corresponding to the 31 wells in the blister card. The drop height of pills was also varied between experiments by 0.25 inch to simulate different conditions experienced by the SYNMED XF system. For control trays 110, the pill was dropped in the center of the receiving aperture 110. For experimental trays 210, the position of the pill drop was offset from the center of the receiving aperture 210 in a direction toward the receiving surface 212*a* (Z-offset—see FIG. 8), with different offset distances being employed.

The dispensing of each pill was recorded with video. Dispensed pills were identified as being in one of four categories: (a) rebounded out of the well; (b) significant rebound, but ended up in the well (indicating a significant chance of rebounding out of the well); (c) some rebound but remained in the well (indicating a moderate chance of rebounding out of the well); and (d) no rebound. Multiple cards (each having 31 wells) were filled during the experiments.

Example 2

Experimental Results

The results from the experiments described in Example 1 are set forth in the chart of FIG. 9. FIG. 9 shows that, for no tray, a rebound of type (a) occurred 4 times in 6 cards, and 25 rebounds of types (b) and (c) (indicating some risk of a rebound occurring) occurred in 6 cards, when the pills were dropped from a lowest height (Test No. 1). Thus, on average ⅔ of blister cards would require a manual post-dispensing correction, with the risk of this number being considerably higher. These numbers were higher when a tray 100 was employed with the cards increased (Test No. 2). In contrast, Test No. 5 shows that, for four trays 200 as shown in FIGS. 6-8, and with a drop position ("Z-offset") of 0.25", no rebounds of type (a) occurred, nor did any rebounds of type (b); 3 rebounds of type (c) occurred, which indicates at most a moderate risk of rebound that requires correction. Thus, the experimental trays 200 performed considerably better than the control blister cards with no trays and the cards with trays 100.

Test Nos. 3 and 4 show results of experiments conducted on trays in which the drop position (Z-offset) was varied from the 0.25" offset of Test No. 5. It can be seen that an offset of 0.25" (which corresponds to the target position T shown in FIG. 8) produced the fewest rebounds of types (a) and (b).

Test No. 6 shows results of experiments in which the pill drop height was varied. The experimental trays 200 as shown in FIGS. 6-8 continued to perform well, producing no rebounds of type (a) and only 3 rebounds of type (b), compared with 4 rebounds of type (a) and 10 rebounds of type (b) for tray 100 (Test No. 2).

Finally, Test Nos. 7-10 show results of experiments using different pills. Pill number 2 is an oblong pill having dimensions of 22 mm×8 mm, and Pill number 3 is a disk-shaped pill having an 11.5 mm diameter. The experimental tray 200 continued to exhibit little to any rebounding with these different pills.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

What is claimed is:

1. A tray for facilitating the dispensing of pharmaceuticals, comprising:
- a generally planar main panel;
- a plurality of receiving apertures arranged in a grid of rows and columns;
- wherein a side wall lines each of the receiving apertures; and
- wherein the side wall comprises a receiving segment and a capture segment, the capture segment opposed to the receiving segment, wherein the receiving segment is positioned directly beneath the receiving aperture and defines a receiving angle relative to the main panel, the receiving angle being between about 30 and 70 degrees, and wherein the receiving segment and the capture segment are not substantially parallel.

2. The tray defined in claim 1, wherein the capture segment is below but not directly beneath the receiving aperture and defines a capture angle relative to the main panel, the capture angle being between about 95 and 160 degrees.

3. The tray defined in claim 1, wherein each of the receiving apertures is generally oblong in shape.

4. The tray defined in claim 3, wherein a width of the receiving apertures is between about 0.6 and 0.8 inches.

5. The tray defined in claim 1, wherein the side wall has a depth of between about 0.25 and 0.5 inch.

6. The tray defined in claim 1, formed of a polymeric material.

7. The tray defined in claim 1, in combination with a blister card having a plurality of wells arranged in a grid of rows and columns, wherein each of the wells underlies one of the plurality of receiving apertures.

8. The combination defined in claim 7, in further combination with a pharmaceutical package filling machine.

9. A pharmaceutical package filling machine, comprising:
- a plurality of containers, each containing pharmaceutical tablets;
- a support surface configured to support a blister card;
- a dispensing tool configured to convey tablets from a container to a blister card supported by the support surface; and
- a tray configured to overlie the blister card supported by the support surface, the tray comprising:
  - a generally planar main panel that overlies the blister card;
  - a plurality of receiving apertures arranged in a grid of rows and columns corresponding to wells in the blister card;
  - wherein a side wall lines each of the receiving apertures; and
  - wherein the side wall comprises a receiving segment and a capture segment, the capture segment opposed to the receiving segment, wherein the receiving segment is positioned directly beneath the receiving aperture and defines a receiving angle relative to the main panel, the receiving angle being between about 30 and 70 degrees, and wherein the receiving segment and the capture segment are not substantially parallel.

10. The machine defined in claim 9, wherein the dispensing tool comprises a plurality of transfer members.

11. The machine defined in claim 10, wherein the transfer members comprise fingers configured to employ suction to convey tablets from the containers to the support surface.

12. The machine defined in claim 9, wherein the capture segment is below but not directly beneath the receiving aperture and defines a capture angle relative to the main panel, the capture angle being between about 95 and 160 degrees.

13. The machine defined in claim 9, wherein each of the receiving apertures is generally oblong in shape.

14. The machine defined in claim 13, wherein a width of the receiving apertures is between about 0.6 and 0.8 inches.

15. The machine defined in claim 9, wherein the side wall has a depth of between about 0.25 and 0.5 inches.

16. The machine defined in claim 9, wherein the tray is formed of a polymeric material.

17. The machine defined in claim 9, in combination with the blister card underlying the tray.

18. A tray for facilitating the dispensing of pharmaceuticals, comprising:
- a generally planar main panel;
- a plurality of receiving apertures arranged in a grid of rows and columns;
- wherein a side wall lines each of the receiving apertures; and
- wherein the side wall comprises a receiving segment and a capture segment, the capture segment opposed to the receiving segment, wherein the receiving segment is positioned directly beneath the receiving aperture and defines a receiving angle relative to the main panel, the receiving angle being between about 40 and 50 degrees, and wherein the capture segment is below but not directly beneath the receiving aperture and defines a capture angle relative to the main panel, the capture angle being between about 95 and 120 degrees.

* * * * *